US006089568A

United States Patent [19]

Milici

[11] Patent Number: 6,089,568

[45] Date of Patent: Jul. 18, 2000

[54] HOCKEY BOARD GAME

[76] Inventor: James M. Milici, 21 Green Knolls Rd., Morristown, N.J. 07960

[21] Appl. No.: 09/175,389

[22] Filed: Oct. 19, 1998

[51] Int. Cl.[7] ..... A63F 3/00

[52] U.S. Cl. ..... 273/244; 273/259; 273/298

[58] Field of Search ..... 273/244, 247, 273/259, 298

[56] References Cited

U.S. PATENT DOCUMENTS 3,907,295 9/1975 Eissler .
5,108,110 4/1992 Nerbas .
5,906,370 5/1999 Poisson .

*Primary Examiner*—William M. Pierce

[57] ABSTRACT

The present invention discloses a hockey board game. The hockey board game comprises a board having a planar lower surface positionable upon a recipient support and an upper surface with indicia for use in playing the game. The board is formed in a rectangular configuration with parallel side edges and parallel end edges. The board has a centrally located center region with a large circle located essentially central therewithin. The indicia neutral zone is located on opposite sides of the circle parallel with the end edges. A first action zone is located to one end edge and a second action zone is located adjacent to the other end edge. Each action zone constitutes about 25 percent of the area of the board and is divided into six rectangles. The rectangles include three primary rectangles adjacent an end edge and three secondary rectangles between the primary rectangles and the central region.

8 Claims, 2 Drawing Sheets

72

| INJURY | |
|---|---|
| 2 | Goalie Injured |
| 3 | No Injury |
| 4 | No Injury |
| 5 | Injury(out for period) |
| 6 | No Injury |
| 7 | No Injury |
| 8 | No Injury |
| 9 | No Injury |
| 10 | Injury(out for game) |
| 11 | Goalie Injured |
| 12 | Injury(out for period) |

72

| INJURY | |
|---|---|
| 2 | Goalie Injured |
| 3 | No Injury |
| 4 | No Injury |
| 5 | Injury(out for period) |
| 6 | No Injury |
| 7 | No Injury |
| 8 | No Injury |
| 9 | No Injury |
| 10 | Injury(out for game) |
| 11 | Goalie Injured |
| 12 | Injury(out for period) |

HOCKEY BOARD GAME

BACKGROUND OF THE INVENTION

1. Field of the Invention

The present invention relates to a new and improved hockey board game and, more particularly, pertains to simulating the actions and strategies of a real hockey game.

2. Description of the Prior Art

The use of games of known designs and configurations is known in the prior art. More specifically, games of known designs and configurations heretofore devised and utilized for the purpose of simulating activities of sports through games by known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of games of known designs and configurations. By way of example, U.S. Pat. No. 5,108,110 to Nerbas, issued Apr. 28, 1992 discloses a game apparatus.

U.S. Pat. No. Des. 294,720 to MacDowell, issued Mar. 15, 1988 discloses a hockey game board.

Foreign Patent Number EP 0 092 921 A1 to Barcelow et al., issued Apr. 6, 1983 discloses an amusement game.

Foreign Patent Number WO 88/00853 to Brown, issued Feb. 11, 1988 discloses a board game.

Lastly, the following expired patents are of interest: U.S. Pat. No. 2,933,316 to Mancini issued Apr. 19, 1960; U.S. Pat. No. 3,907,295 to Eissier, issued Sep. 23, 1975; and U.S. Pat. No. 4,010,957 to Tricoli, issued Mar. 8, 1977.

In this respect, the hockey board game according to the present invention substantially departs from the conventional concepts and designs of the prior art, and in doing so provides an apparatus primarily developed for the purpose of simulating the actions and strategies of a real hockey game.

Therefore, it can be appreciated that there exists a continuing need for a new and improved hockey board game which can be used for simulating the actions and strategies of a real hockey game. In this regard, the present invention substantially fulfills this need.

SUMMARY OF THE INVENTION

In view of the foregoing disadvantages inherent in the known types of games of known designs and configurations now present in the prior art, the present invention provides a new and improved hockey board game. As such, the general purpose of the present invention, which will be described subsequently in greater detail, is to provide a new and improved hockey board game and methods which have all the advantages of the prior art and none of the disadvantages.

To attain this, the present invention essentially comprises a new and improved hockey board game to simulate the action and strategies of a real hockey game comprising, in combination, a board having a planar lower surface positionable upon a recipient support and an upper surface with indicia for use in playing the game, the board being in a rectangular configuration with parallel side edges and parallel end edges, the board having a centrally located center region with a large circle located essentially central therewithin and with the indicia neutral zone located on opposite sides of the circle parallel with the end edges; a first action zone located to one end edge and a second action zone located adjacent to the other end edge, each action zone constituting about 25 percent of the area of the board and divided into six rectangles, the rectangles including three primary rectangles adjacent an end edge and three secondary rectangles between the primary rectangles and the central region, the rectangle adjacent each corner of the board being formed with a smaller circle, the rectangles adjacent the edges including indicia of left circle (4), followed by low slot (6), followed by right circle (5), the rectangles thereadjacent including indicia of left point (1), high slot (3), and right point (2); a plurality of six player pieces of a first color and six player pieces of another color, the six player pieces being individually marked as C, RW, RD, G, LW and LD; a first stack of player cards each having the name of a player thereon; a deck of position cards, each having the name of a position thereon; a pair of dice to be rolled by the players in sequential fashion to instruct the player as to the number of plays that may be made on such player's turn on alternate sequential courses of action; an injury card for determining extents of injury; and a hockey board game instruction booklet to inform the players as to the rules of the game.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hockey board game which has all the advantages of the prior art games of known designs and configurations and none of the disadvantages.

It is another object of the present invention to provide a new and improved hockey board game which may be easily and efficiently manufactured and marketed.

It is a further object of the present invention to provide a new and improved hockey board game which is of a durable and reliable construction.

An even further object of the present invention is to provide a new and improved hockey board game which is susceptible of a low cost of manufacture with regard to both materials and labor, and which accordingly is then susceptible of low prices of sale to the consuming public, thereby making such a hockey board game economically available to the buying public.

Even still another object of the present invention is to simulate the actions and strategies of a real hockey game.

Lastly, it is an object of the present invention to provide a hockey board game. The hockey board game comprises a board having a planar lower surface positionable upon a recipient support and an upper surface with indicia for use in playing the game. The board is formed in a rectangular configuration with parallel side edges and parallel end edges. The board has a centrally located center region with a large circle located essentially central therewithin. The indicia neutral zone is located on opposite sides of the circle parallel with the end edges. A first action zone is located to one end edge and a second action zone is located adjacent to the other end edge. Each action zone constitutes about 25 percent of the area of the board and is divided into six rectangles. The rectangles include three primary rectangles adjacent an end edge and three secondary rectangles between the primary rectangles and the central region.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
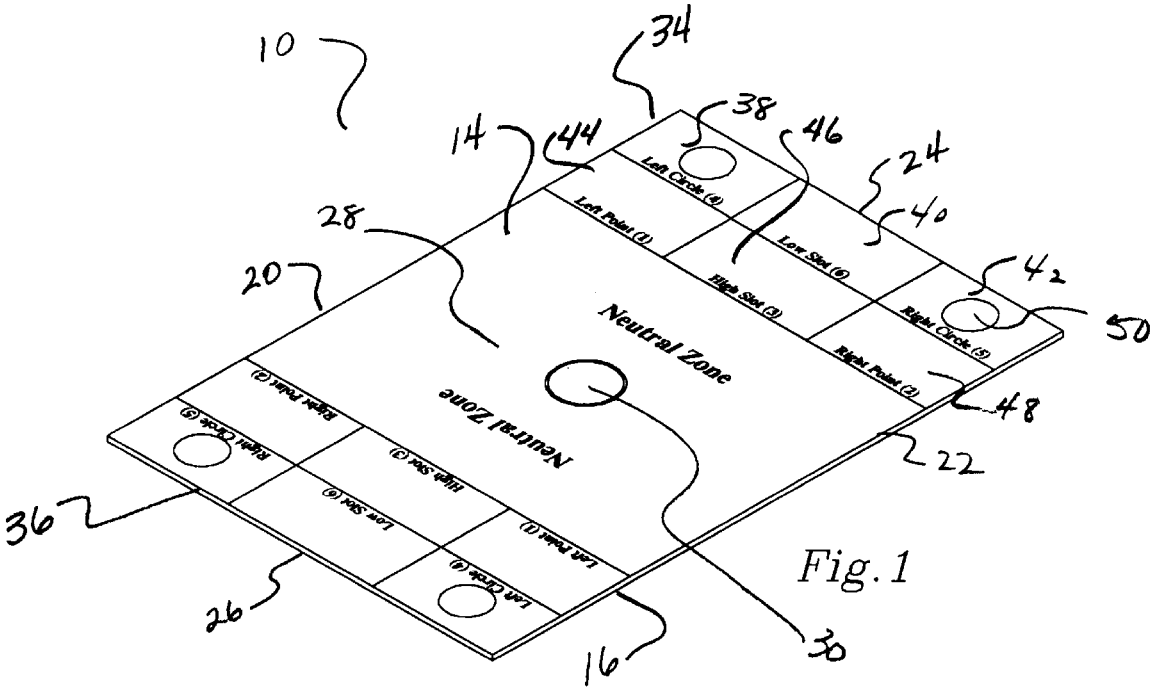
FIG. 1 is a perspective view of the board of the hockey board game constructed in accordance with the principles of the present invention.
Figure 2:
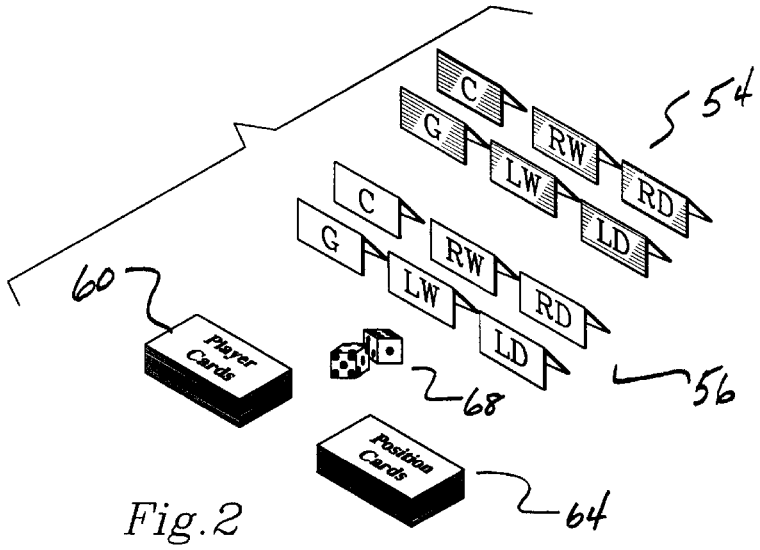
FIG. 2 is a perspective view of the player cards, position cards, dice and player pieces for use in association with the board of FIG. 1.
Figures 3, 4:
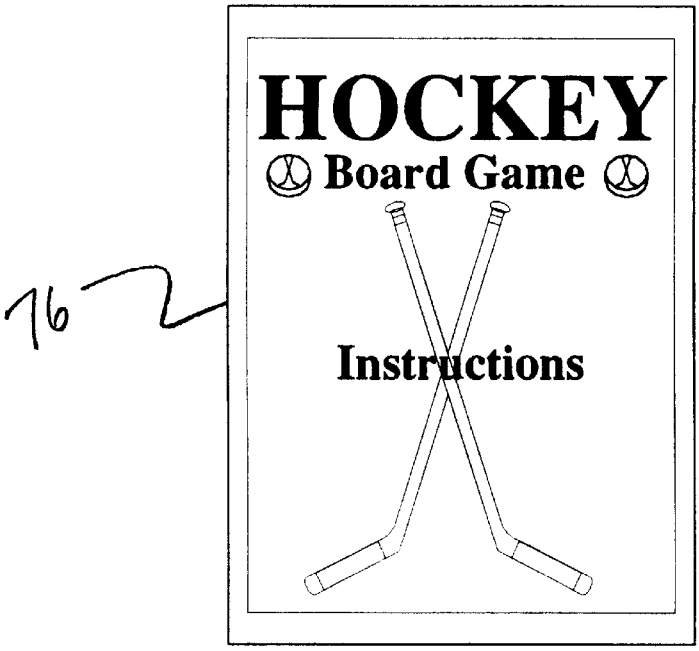
FIG. 3 is a front elevational view of the instruction book.
FIG. 4 is a front elevational view of a typical injury card.

With reference now to the drawings, and in particular to FIGS. 1 through 4 thereof, the preferred embodiment of the new and improved hockey board game embodying the principles and concepts of the present invention and generally designated by the reference numeral 10 will be described.

The present invention, the new and improved hockey board game, is a game 10 comprised of a plurality of components. Such components, in their broadest context, include a board, first and second action zones, player pieces, player cards, position cards, dice, an injury card, and an instruction booklet. Each of the individual components is specifically configured and correlated one with respect to the other so as to attain the desired objectives.

The hockey board game 10 includes a board 14. The board 14 has a planar lower surface 16 positionable upon a recipient support. The board also has an upper surface 18 with indicia for use in playing the game. The board is formed in a rectangular configuration with parallel side edges 20,22 and parallel end edges 24,26. The board has a centrally located center region 28 with a large circle 30 located essentially central therewithin. The indicia neutral zone is located on opposite sides of the circle parallel with the end edges.

The board is provided with a first action zone 34 located to one end edge and a second action zone 36 located adjacent to the other end edge. Each action zone constitutes about 25 percent of the area of the board and is divided into six rectangles. The rectangles include three primary rectangles 38,40,42 adjacent an end edge and three secondary rectangles 44,46,48 between the primary rectangles and the central region. The rectangle adjacent each corner of the board is formed with a smaller circle 50. The rectangles adjacent the edges include indicia of left circle (4), followed by low slot (6), followed by right circle (5), the rectangles thereadjacent including indicia of left point (1), high slot (3), and right point (2).

Next provided is a plurality of six player pieces 54 of a first color and six player pieces 56 of another color. The six player pieces are individually marked as C, RW, RD, G, LW and LD.

Also provided is a first stack of player cards 60 each having the name of a player thereon.

Further provided is a deck of position cards 64, each card having the name of a position thereon.

A pair of dice 68 is also provided. The pair of dice is rolled by the players in sequential fashion to instruct the player as to the number of plays that may be made on such player's turn on alternate sequential courses of action.

Further provided is an injury card 72 for determining extents of injury.

Lastly provided is a hockey board game instruction booklet 76 to inform the players as to the rules of the game.

Game Instructions:

Assembling Line—Each team assembles its lines as follows:

| Line 1 | Line 2 | Line 3 | Line 4 |
|---|---|---|---|
| Center | Center | Center | Center |
| Right Wing | Right Wing | Right Wing | Right Wing |
| Left Wing | Left Wing | Left Wing | Left Wing |
| Right Defense | Right Defense | Right Defense | |
| Left Defense | Left Defense | Left Defense | |

The visiting team must establish its lines first. The home team then sets its lines, keeping in mind the strategy of trying to neutralize the opponent's scoring potential while maximizing its own offensive capability. For example, the visiting team assembles a high scoring first line. The home team may want to counteract this by constructing a first line "checking line" including players, especially the Center, Right and Left Defenseman, who are particularly adept defensively. Each player card indicates defensive ratings within particular defensive schemes. It is crucial to use, as often as possible, the defensive scheme that best suits your team of players. For ease of reference, a scheme profile has been included for each of the teams. One should, whenever possible, use the defensive scheme with the highest rating.

Setting the Defensive Scheme—In the first and third period, each team chooses its defensive scheme with the objective of maximizing its defensive capability. Each NHL team can play schemes. Possible defensive schemes are: Neutral Zone Trap, 1-2-2 Forecheck (passive trap), Forecheck (aggressive forecheck), Dump and Chase, Defensive Pinch, and Left Wing Lock.

Setting Your Defensive Scheme—As previously mentioned, in the first and third period, a player can choose whatever he or she would like in order to maximize his/her team's defensive skill. However, in the second period, the defensive scheme is chosen by a role of the die. For example, if you roll a two and that two corresponds to Dump and Chase, then your team must play the dump and chase style (even if that is not their optimal defensive mode). This adds flexibility to the game by forcing teams to play a style other than the one most suited to that team's characteristics. For an exceptional defensive team, this rule may not have such a great impact. For the less skillful-defensive teams who must play a certain defensive style to maximize effectiveness, this provision could have a negative impact.

Double Shifted Lines—Each team is allowed to double shift one of its lines once per period. The line to be double shifted is determined by a roll of the die. If the die roll is one, then the first line is double shifted. If it is four, then the fourth line is double shifted.

To Begin Play—The home team positions its players in its defensive zone. Each player of the first line (in Period 1) occupies a defensive zone square as follows: Center=High Slot (3); Right Wing=Left Point (1); Left Wing=Right Point (2); Right Defenseman=Left Circle (4); Left Defenseman=Right Circle (5).

Each square is numbered for ease of maneuverability as follows: Low Slot=6; Right Circle=5; Left Circle=4; High Slot=3; Right Point=2; Left Point=1.

The die is then rolled for each of these players and each player moves up, down, or stays on the square accordingly. For example, the defensive scheme chosen is Neutral Zone Trap. The die is rolled for the first line center. The number rolled is 4. The game participant would look under the Center's Neutral Zone Trap category for the corresponding indicator for the die roll of 4.(If an up arrow appears, move the center token to the next highest square (Left Circle). If a down arrow appears, move the center token to the right point square. If a dash appears, do not move the Center token. This procedure must be done for each of the line's players to determine the ultimate or penultimate defensive position. At that point the offense begins to enter the zone.

Please note that the objective for the defending team is to have as many players as possible occupy squares as close to the defending goal as possible. To the degree that this is achieved, it is much harder for the attacking team to score.

Once the defensive configuration is established, the attacking team begins to enter the zone. For each of the first line players, beginning with the Center, the die is rolled. If, for example, a six is rolled for the first line Center, the Center should be moved to the square indicated under the offense category corresponding with six. If the indicator shows Right Circle, the first line center should be moved to the right circle in the opposing team's zone. When all attacking players have gained the zone, a final adjustment of the position is made. Attacking players are sent back a certain number of squares if those squares are occupied by the opposing team's player(s). For example, if an attacking team's Right Wing occupies the left circle which is also occupied by the defending team's player(s), then the attacking Right Wing is sent back one square to the High Slot square. This adjustment is made on a player by player basis. Thus, if two or more attacking players occupy one of the defending team's squares, both of those players are sent back if the square is occupied by two or more defending players. Attacking players are sent back one square unless they occupy the Low Slot or Right Circle. If an attacking player occupies the Low Slot or Right Circle, that player is sent back to the High Slot provided the sendback square was occupied by a defending player(s). Once this procedure is done for all first line players, it is time to determine shots on goal. Once the first line shots on goal are determined, the second lines begin their shifts until all four lines have been utilized. When this is done, the first period is over and the second period begins. Please note that the second period begins play with the second line and the third period begins with third line players (See Line Sequence by Periods).

Shots on Goal—When both the defensive and offensive positions are established, three position cards, one at a time, are turned over by the attacking team. Three is the maximum number of shots on goal for any line during any one shift. If, for example, the first position card indicates "Left Defenseman", then the Left Defenseman gets a chance-at shot on goal based on his position in the attack zone. If, for example, the Left Defenseman is occupying the High Slot square, then that player's Shot on Goal grid is looked at. The die is rolled again and the number of x's is determined on the basis of the roll in the High Slot shot category. If, for example, the die roll corresponds with 2X, the defending team then rolls the dice to determine their ability to stop the shot. If the corresponding X value in left corner of goalie card is 3X the shot is stopped; if 1X a goal is scored; if 2X then the tie breaker for that value, Column 3 of goalie card, is used. The dice is rolled again and a save is made or a goal is scored accordingly. All X ties are resolved in this fashion.

The above procedure is followed for all four lines of both teams on an alternating basis.

Keep in mind that when a line is double shifted, the offensive and defensive tokens will be re-positioned twice. The defensive tokens should not be re-positioned to their original places between a double-shifted lines first and second shift. Instead, they are re-positioned from the point of their last occupied square.

Note: If an attacking player has not gained the attack zone (he is occupying the neutral zone) and his position card is turned over, then no shot is registered for that player.

Line Sequence by Periods are as follows:

| Period | Line Sequence |
|---|---|
| 1st | 1, 2, 3, 4 |
| 2nd | 2, 3, 4, 1 |
| 3rd | 3, 4, 1, 2 |
| OT* | 4, 1, 2, 3, etc. |

Penalty—A penalty is assessed when indicated on a defensive player's defensive key. When a penalty is assessed, the guilty player must be removed from the board and placed in the penalty box. He must remain in the penalty box for the entire duration of his defensive shift and his ensuing offensive shift, if any. A team cannot be shorthanded more than two players an any one shift.

Injury—An injury can occur when indicated on a defensive player's key. If the key indicates an (I), the dice must be rolled to determine the extent of that injury or if there is no injury, as indicated on the Injury Card. There can also be an injury to a goalie based on this provision. If so, the backup goaltender must be brought in for the remainder of the period or the whole game, depending on the extent of the injury according to the Injury Card. If a player is injured for an entire game, he must be removed from action and his linemates must play shorthanded for the remainder of the game. If a player is injured for one period, his position token must be removed from the board and the player is inactive for that period.

Last Shift of the Game—Each team has the option to pull their goalie and use an extra skater from any line on their last shift of the game. If no score is tallied by the attacking team using this method, then the defending team automatically gets a goal.

There is only one shift in a regular season overtime. If no goal is scored, the game is declared a tie.

The present invention is a game which uses strategy and skill to recreate the experience of live hockey in a board game format.

The present invention features a game board, player cards, and complete rules and instructions. Each team has four lines, just like in real hockey. All except the fourth are comprised of a Center, Right Wing, Left Wing, Right Defenseman and Left Defenseman.

Each line is assembled and separated before play begins. Each team chooses a style of play, for example, Neutral Zone Trap or Aggressive Forecheck, that best suits its personnel. The game begins by setting the board position of the defending team's first line players. Based on a roll of the dice, each of the defending team's first line players will guard an area of that team's defensive zone. The idea is to guard the areas closest to the goal net in order to minimize the scoring potential of the attacking team's players. Once this is done, the attacking team positions itself in the attack zone, again based on a roll of the dice, in an effort to score a goal. If the attacking player occupies an area of the board guarded by a defending player then the attacking player is sent back X number of squares, thus minimizing an opportunity for a scoring chance.

Once both teams are established in the zone, three position cards are turned over and shots on goal are determined. For example, if a position card labeled "Right Wing" is turned over then the attacking team's right wing gets a shot on the goal and the effectiveness of the shot is determined based on the board sector he occupies relative to the goal net.

Each player gets one or two shifts per period and may get as many as six shots on goal per period. Once both teams' first line players have had an opportunity to attack, the second line players follow the procedure outlined. The whole process culminates with the shifting of each team's fourth line. At that point the period ends and the next period begins.

The strategies employed in this game are almost limitless. Each team has the opportunity to utilize actual NHL players in an effort to maximize defensive ability and scoring potential. Creating one's own lines makes it possible to seek out match-ups that are advantageous to your team. This game is an extremely accurate representation of the dynamics of live-action hockey. In essence, each player is the coach behind the bench of a real NHL team!

All player card values are based on formulas devised to assess each player's capabilities. The formulas include a defensive key and assessments of each player's strengths and ability to perform various maneuvers common in the game of ice hockey. For example, forwards and defensemen are evaluated based on facets of play such as slapshot, power play and centering pass. Other categories include backchecking, forechecking and clearing attempt. The goalies are evaluated based on goals against average and save percentage in addition to many other categories.

As described in the foregoing paragraph, the following five tables illustrate typical player cards utilized in the present invention.

| Joe Mullen<br>Pittsburgh Penguins | Right Wing | Off/96 | D/15.5 |
|---|---|---|---|
| | Defensive Key: | | Dump and |
| Offensive Key | Forecheck* | Defensive Pinch | Chase |
| 1. Right Point | 1. ↑ | 1. ↑ | 1. ↓ |
| 2. Right Point | 2. — | 2. ↓ | 2. — |
| 3. Left Circle | 3. — | 3. — | 3. — (I) |
| 4. High Slot | 4. ↑ | 4. — | 4. ↓ |
| 5. High Slot | 5. — | 5. ↓ | 5. ↑ |
| 6. Left Circle | 6. ↑ | 6. — | 6. ↑ |
| | 9.0 | 3.0 | 3.5 |

| Shot on Goal | 1 | 2 | 3 | 4–6 |
|---|---|---|---|---|
| Left Circle | XX | XX | XXX | XXX |
| High Slot | X | X | X | XX |
| Right Point | X | XX | XX | X |
| Left Point | X | X | X | X |

| Jaromir Jagr<br>Pittsburgh Penguins | Right Wing | Off/103 | D/23 |
|---|---|---|---|
| | Defensive Key: | | Dump and |
| Offensive Key | Forecheck* | Defensive Pinch | Chase |
| 1. Left Point | 1. ↑ | 1. — | 1. ↑ |
| 2. Low Slot | 2. — | 2. ↓ | 2. — |
| 3. High Slot | 3. ↑ | 3. — | 3. ↑ |
| 4. Right Point | 4. ↑ | 4. ↑ | 4. — |
| 5. Right Point | 5. ↑ | 5. — | 5. ↑ |
| 6. Right Circle | 6. ↑ | 6. ↓ | 6. — |
| | 11.0 | 3.0 | 9.0 |

| Shot on Goal | 1 | 2 | 3 | 4–6 |
|---|---|---|---|---|
| Low Slot | XXX | XX | XX | XXX |
| Right Circle | XX | XX | XXX | XXX |
| High Slot | XX | XX | XX | X |
| Right Point | XX | X | XX | X |
| Left Point | X | X | X | X |

| Mario Lemieux<br>Pittsburgh Penguins | Center | Off/129 | D/18.5 |
|---|---|---|---|
| | Defensive Key: | | Dump and |
| Offensive Key | Forecheck* | Defensive Pinch | Chase |
| 1. Low Slot | 1. — | 1. — | 1. ↑ |
| 2. Right Point | 2. ↑ | 2. ↓ (I) | 2. — |
| 3. Low Slot | 3. ↑ | 3. — | 3. — |
| 4. Right Circle | 4. — (I) | 4. ↑ | 4. ↓ |
| 5. Left Circle | 5. ↑ | 5. ↓ | 5. ↑ (I) |
| 6. Left Point | 6. ↑ | 6. ↑ | 6. — |
| | 9.5 | 3.5 | 5.5 |

| Shot on Goal | 1 | 2 | 3 | 4–6 |
|---|---|---|---|---|
| Low Slot | XXX | XXX | XXX | XXX |
| Right Circle | XXX | XXX | XXX | XXX |
| Left Circle | XXX | XX | XXX | XXX |
| High Slot | XX | XX | XX | X |
| Right Point | X | XX | XX | X |
| Left Point | X | X | X | X |

| Mike Stapleton<br>Pittsburgh Penguins | Center | Off/45 | D/-1 |
|---|---|---|---|
| | Defensive Key: | | Dump and |
| Offensive Key | Forecheck | Defensive Pinch | Chase* |
| 1. Right Point | 1. ↓ | 1. — | 1. — |
| 2. Left Point | 2. ↓ | 2. ↓ | 2. — |
| 3. Left Point | 3. — | 3. ↓ | 3. ↓ |
| 4. Left Point | 4. ↓ | 4. — | 4. ↑ |
| 5. Left Point | 5. — | 5. ↓ | 5. ↓ |
| 6. Right Point | 6. ↓ | 6. — | 6. ↓ |

-continued

| Shot on Goal | −2.0 1 | 0.0 2 | 3 | 1.0 4–6 |
|---|---|---|---|---|
| Right Point | XX | X | X | X |
| Left Point | X | 0 | X | X |
| Ken Wregget Pittsburgh Penguins | | 92/93 X | Goalie Rating: 91 XX | XXX |
| 2. | XXX | Save | Goal | Goal |
| 3. | X | Save | Save | Goal |
| 4. | XXX | Goal | Save | Save |
| 5. | XX | Save | Goal | Save |
| 6. | XXX | Goal | Save | Goal |
| 7. | XX | Save | Goal | Goal |
| 8. | XXX | Goal | Goal | Goal |
| 9. | XXX | Save | Save | Save |
| 10. | XX | Save | Save | Save |
| 11. | XXX | Save | Goal | Goal |
| 12. | X | Goal | Save | Goal |
| | | 61% | 50% | 39% |

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved hockey board game to simulate the action and strategies of a real hockey game comprising, in combination:

a board having a planar lower surface positionable upon a recipient support and an upper surface with indicia for use in playing the game, the board being in a rectangular configuration with parallel side edges and parallel end edges, the board having a centrally located center region with a large circle located essentially central therewithin and with the indicia neutral zone located on opposite sides of the circle parallel with the end edges;

a first action zone located to one end edge and a second action zone located adjacent to the other end edge, each action zone constituting about 25 percent of the area of the board and divided into six rectangles, the rectangles including three primary rectangles adjacent an end edge and three secondary rectangles between the primary rectangles and the central region, the rectangle adjacent each corner of the board being formed with a smaller circle, the rectangles adjacent the edges including indicia of left circle (4), followed by low slot (6), followed by right circle (5), the rectangles thereadjacent including indicia of left point (1), high slot (3), and right point (2);

a plurality of six player pieces of a first color and six player pieces of another color, the six player pieces being individually marked as C, RW, RD, G, LW and LD;

a first stack of player cards each having the name of a player thereon;

a deck of position cards, each having the name of a position thereon;

a pair of dice to be rolled by the players in sequential fashion to instruct the player as to the number of plays that may be made on such player's turn on alternate sequential courses of action;

an injury card for determining extents of injury; and a hockey board game instruction booklet to inform the players as to the rules of the game.

2. A hockey board game comprising:

a board having a planar lower surface positionable upon a recipient support and an upper surface with indicia for use in playing the game, the board being in a rectangular configuration with parallel side edges and parallel end edges, the board having a centrally located center region with a large circle located essentially central therewithin and with the indicia neutral zone located on opposite sides of the circle parallel with the end edges;

a first action zone located to one end edge and a second action zone located adjacent to the other end edge, each action zone constituting about 25 percent of the area of the board and divided into six rectangles, the rectangles including three primary rectangles adjacent an end edge and three secondary rectangles between the primary rectangles and the central region; and a plurality of six player pieces of a first color and six player pieces of another color, the six player pieces being individually marked as C, RW, RD, G. LW and LD.

3. The hockey board game as set forth in claim 2 whereby the rectangle adjacent each corner of the board being formed with a smaller circle, the rectangles adjacent the edges including indicia of left circle (4), followed by low slot (6), followed by right circle (5), the rectangles thereadjacent including indicia of left point (1), high slot (3), and right point (2).

4. The hockey board game as set forth in claim 2 and further including a first stack of player cards each having the name of a player thereon.

5. The hockey board game as set forth in claim 2 and further including a deck of position cards, each having the name of a position thereon.

6. The hockey board game as set forth in claim 2 and further including a pair of dice to be rolled by the players in sequential fashion to instruct the player as to the number of plays that may be made on such player's turn on alternate sequential courses of action.

7. The hockey board game as set forth in claim 2 and further including an injury card for determining extents of injury.

8. The hockey board game as set forth in claim 2 and further including an instruction booklet to inform the players as to the rules of the hockey board game.

* * * * *